US009586732B2

(12) United States Patent
Son

(10) Patent No.: US 9,586,732 B2
(45) Date of Patent: Mar. 7, 2017

(54) DRINK CAN LID COMPRISING AN ARTICULATED NECK

(71) Applicant: Paul Son, Marche-en-Fammenne (BE)

(72) Inventor: Paul Son, Marche-en-Fammenne (BE)

( * ) Notice: Subject to any disclaimer, the term of this patent is extended or adjusted under 35 U.S.C. 154(b) by 2 days.

(21) Appl. No.: 14/394,808

(22) PCT Filed: Apr. 16, 2013

(86) PCT No.: PCT/EP2013/057941
§ 371 (c)(1),
(2) Date: Oct. 16, 2014

(87) PCT Pub. No.: WO2013/156495
PCT Pub. Date: Oct. 24, 2013

(65) Prior Publication Data

US 2015/0069079 A1 Mar. 12, 2015

(30) Foreign Application Priority Data

Apr. 16, 2012 (BE) ..... 2012/0252

(51) Int. Cl.

| | |
|---|---|
| ***B65D 47/06*** | (2006.01) |
| ***B65D 25/46*** | (2006.01) |
| ***B65D 41/00*** | (2006.01) |
| ***B65D 51/16*** | (2006.01) |

(52) U.S. Cl.
CPC ..... *B65D 47/066* (2013.01); *B65D 25/465* (2013.01); *B65D 41/005* (2013.01); *B65D 51/16* (2013.01); *B65D 2205/02* (2013.01)

(58) Field of Classification Search
USPC ..... 220/254.3, 705; 222/534
See application file for complete search history.

(56) References Cited

U.S. PATENT DOCUMENTS

| | | | | |
|---|---|---|---|---|
| 5,392,968 | A * | 2/1995 | Dark | 222/529 |
| 7,059,490 | B2 | 6/2006 | Son | |
| 2004/0069783 | A1* | 4/2004 | Chen | A47G 19/2266 220/254.3 |
| 2005/0040169 | A1 | 2/2005 | Son | |

FOREIGN PATENT DOCUMENTS

| | | |
|---|---|---|
| DE | 30 23 751 | 1/1982 |
| EP | 1 456 093 | 9/2004 |
| WO | 0059795 | 10/2000 |

OTHER PUBLICATIONS

International Search Report dated Jun. 7, 2013, corresponding to PCT/EP2013/057941.

* cited by examiner

*Primary Examiner* — Anthony Stashick
*Assistant Examiner* — Madison L Poos
(74) *Attorney, Agent, or Firm* — Young & Thompson

(57) ABSTRACT

A plastic lid for a metal can including a liquid. The lid includes a cavity (20) receiving a neck (15) that can be folded down and secured to a wall section (21) of the cavity. The free end of the folded-down neck (15) compresses a wall (23) of the cavity and seals the can, closing an air intake slit (27) provided in an elastomer material (29).

15 Claims, 4 Drawing Sheets

DRINK CAN LID COMPRISING AN ARTICULATED NECK

FIELD OF THE INVENTION

The present invention relates to drinks containers such as drinks cans equipped with a closing cap and a spout. It has to do in particular with a lid for such cans.

PRIOR ART

When a consumer wishes to drink directly out of a can after removing the closing cap, he must usually place his lips against the outer surface of the can. This outer surface is usually contaminated with all kinds of dirt and pollution resulting from warehousing and handling of various kinds during packaging, transport and storage of the cans.

In the distribution networks, too, the cans are handled repeatedly by different people. In supermarket refrigerators, for example, the cans are handled by a large number of people, typically to check them for coolness. Furthermore, the cans are often set down on the ground and are thus within the reach of animals or can come into contact with chemicals, detritus, grease, oils, etc. All this means that drinks cans currently on the market are of doubtful hygiene. Besides this, when a consumer, especially a child, drinks directly from the can, it is not uncommon for him to injure his lips or tongue.

In order to prevent the can from being contaminated with various kinds of dirt and pollution and to allow the consumer to drink directly from the can in a sanitary condition, it has already been proposed to fit cans with a spout member that flips out when the cap is detached from the lid.

For example, U.S. Pat. No. 4,407,425, describes a container lid comprising a tubular component folded up underneath the detachable cap, that flips out when the cap is detached from the lid. That lid does not allow reclosure of the can after it has been opened.

However, with drinks containers or cans, even if equipped with a spout that flips out when the closing cap is detached from the lid, there is presently the problem that when the contents of the container are not all drunk in one go, it is not really possible to reclose the container hermetically. Furthermore, the flow through the spout is not always excellent and it is therefore often difficult to empty the container completely. Also, when the spout is flipped up out of the can, some of the drink is often spilled onto the top surface of the can or into the lip usually present on the can lid.

Publication WO-0059795 describes a lid equipped with a removable spout arranged in such a way as to be able to pivot between a down position and an up position and vice-versa, and a closing cap that makes it possible to recluse the cap after it has been opened. European patent specification EP 1456093 B1 describes a beverage can lid with an articulated neck. A semi-rigid sealing closure is provided and two ventilation holes (air inlet) are sealed when the closure is located in the lowered position. The efficacy of these ventilation holes and leakproofness of the system have proven to be in need of improvement, however.

SUMMARY OF THE INVENTION

The invention aims to remedy the drawbacks mentioned above by proposing a lid which is improved relative to the lid described in EP 1456093.

In the following description, the term can is used to denote a receptacle of any form, equipped with an opening means and capable of containing and holding a liquid, i.e. not solely a cylindrical aluminum can.

The invention substantially provides a beverage can lid equipped with an articulated rigid neck which may be opened up so as to allow the beverage contained in the can to be drunk and which may then be folded back down to close the can hermetically so as to preserve the remaining portion of the beverage for subsequent consumption. The invention further provides a beverage can lid equipped with a sealing closure and an articulated neck which can be opened up and folded back down, which makes it possible to empty said can completely and which is arranged so as prevent liquid from overflowing and splashing when the closure is brought into its raised position or has been completely removed.

The beverage can lid according to the invention is generally made of non-elastomeric plastics, e.g. polypropylene, and may comprise a generally planar part, in the middle of which is formed a cavity, for example generally oblong or circular in shape. The cavity has a bottom which holds a neck connected with an opening in communication with the contents of the can. A sealing closure may be attached to the periphery of the planar part or at the level of a metallic ring holding said lid, by heat-sealing a rigid or flexible sheet for example of or based on aluminum.

The neck is rigid and is attached to a side wall section of the cavity so as to be able to pivot between a lowered position inside the cavity and a position raised towards the outside of the planar part. A flexible, leakproof membrane connects a part of the periphery of the opening formed in the bottom of the cavity to the part of the periphery of the neck which is not attached to the side wall of the cavity. When it is located in the lowered position, the bottom end of the neck is located against the side wall of the cavity to which it is attached, such that, in this position of the neck, its internal channel is not in communication with the interior of the can. According to the invention, leakproofness is advantageously ensured by an elastomeric element allowing a degree of compression of the material. On the other hand, when the neck is in the raised position, its internal channel pivots and is in communication with the interior of the can by a free passage uncovered by the flexible membrane, which allows a consumer to drink the contents of the can by placing his or her lips on the free end of the raised neck.

The design of the lid according to the invention makes it possible to fold the neck back down with perfect leakproofness, even after any closure has been removed or raised and the neck has been raised outwards to allow partial consumption of the beverage contained in the can. Said can may thus be reclosed if its contents are not all drunk at once. This prevents insects or any waste from getting into the interior of the can and into the beverage.

According to the invention, the lid is advantageously provided with at least one opening passing through it, functioning as an air inlet, provided in part of resilient material capable of being reclosed under the action of lateral compression exerted by the neck in the folded-down position.

The opening advantageously takes the form of an open slot allowing intake of air to compensate the outflow of liquid, so ensuring excellent outflow into the neck and good emptying of the can. Furthermore, the lid is substantially flat and does not modify the usual external dimensions of standard cans, which means the cans can be stacked in conventional dispensing machines.

The resilient material is advantageously an elastomeric material, such that the opening or slot may reclose under the action of the compression exerted by the discharge end of the neck which, as already mentioned, in the closed position in effect compresses said elastomeric element laterally and perpendicularly to the slot, thereby reclosing it and ensuring leakproofness in the reclosed position.

According to a preferred embodiment, this latter elastomeric element is advantageously provided in one piece with another elastomeric part ensuring the leakproofness of the base of the reclosed neck, relative to the contents of the can. This element may be incorporated into the lid by its internal face, so facilitating the manufacturing process thereof.

Other features and advantages of the invention will become apparent on reading the following description, made with reference, solely by way of example, to the appended drawings.

DETAILED DESCRIPTION

Figure 1:
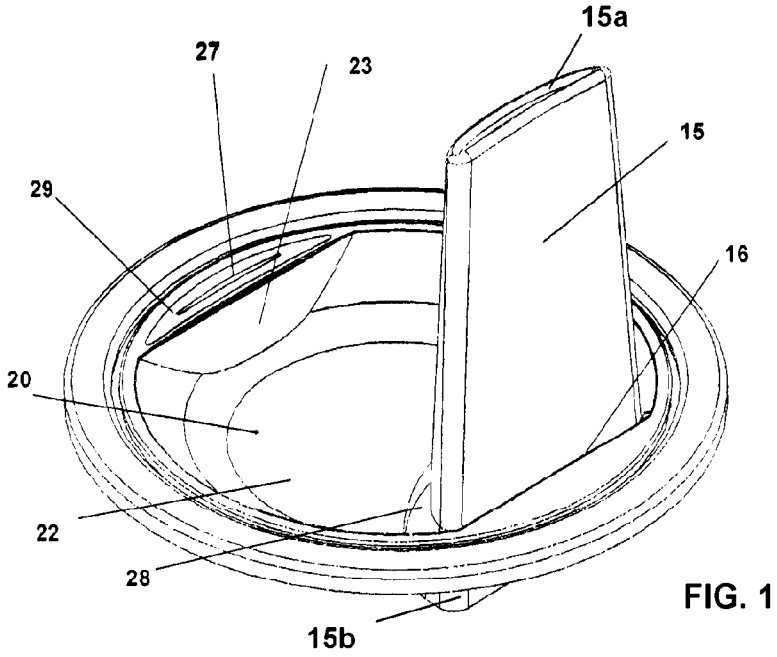
FIG. 1 is a perspective view of a beverage container lid according to the invention, with the neck in the raised position.
Figure 2:
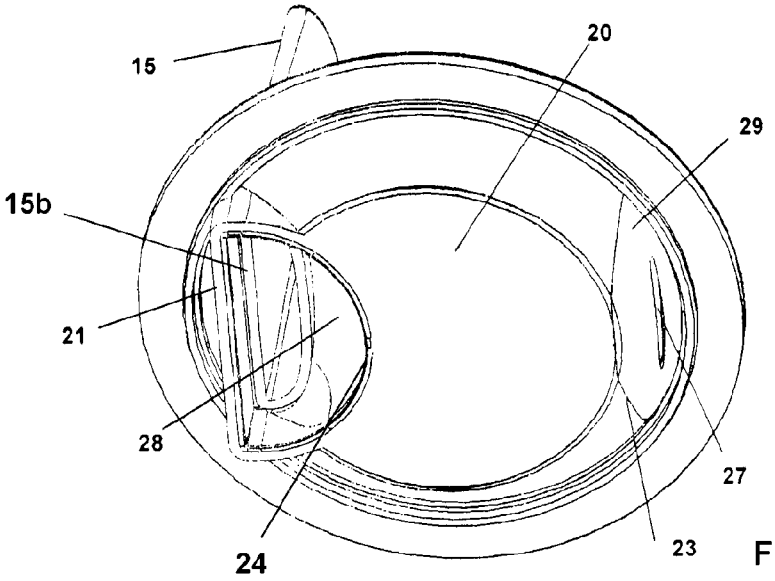
FIG. 2 shows the lid of FIG. 1 viewed from beneath and slightly obliquely.

FIGS. 1 and 2 show a can lid having a cavity 20, formed at the center of the lid and capable of extending over a substantial part of the surface thereof.

A neck 15 is accommodated in said cavity, integral with a portion of the side wall 21 of the cavity.

Figure 5:
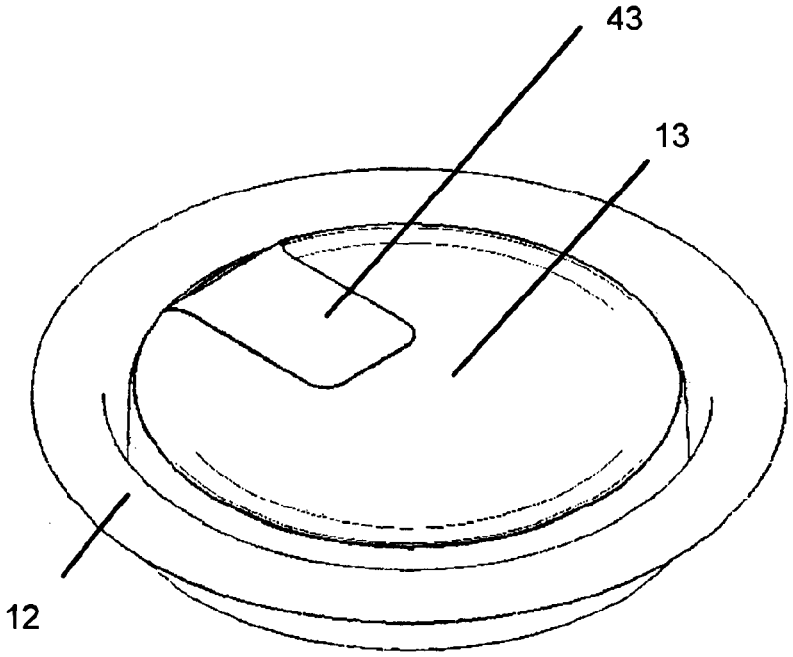
FIG. 5 is a schematic representation of a can lid provided with its closure 13 with a tab 43, firmly connected around a periphery incorporated into an aluminum ring 12 associated therewith, said ring being intended for fixing to the can, e.g. by crimping.
Figure 6:
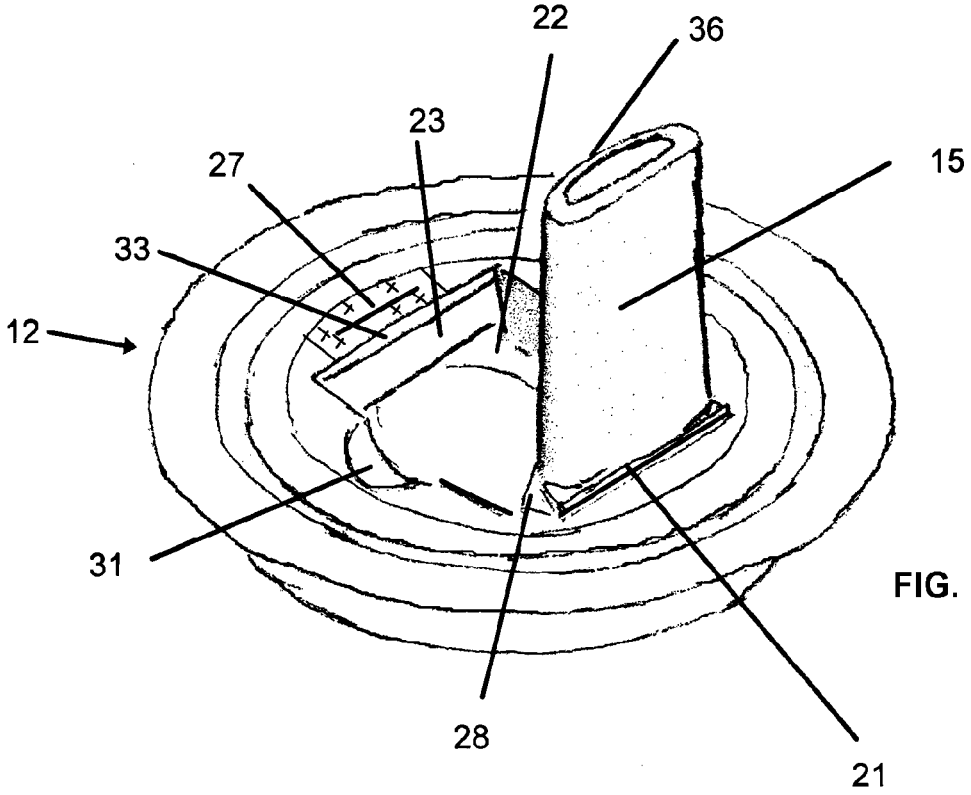
FIG. 6 is a schematic representation of a can lid according to a variant embodiment, after the closure 13 with the tab 43 has been torn off and the neck has been raised.

The lid 1 is preferably connected with a sealing closure 13 (FIGS. 3 and 5), for example applied by heat-sealing, which may be torn away completely or partially.

When said closure 13 has been raised or removed, it opens up in the middle of the lid a cavity 20, of oblong or circular general shape, in which a neck 15 is accommodated which is integral with a portion of the side wall 21 of the cavity.

Opposite said side wall 21 of the cavity is a wall 23 frictionally receiving the free end 15*a* of the neck in the lowered position. Behind this wall is a ventilation opening or slot 27 provided in an elastomeric element 29, such as a rubber at the periphery of the cavity and which, when the neck is in the raised position, is opened up and then allows air to enter the interior of the receptacle or can when not compressed. This sets the liquid contained in the receptacle to atmospheric pressure and facilitates emptying of the can. The elastomeric element may be an elastomer sold under the trademark TREFSIN® or SANTOPRENE®.

The neck 15 is preferably composed of a relatively rigid, flattened tube having a sufficiently large cross-section to ensure good flow of liquid and complete emptying of the can.

The end of the neck 15*b* is attached over a certain amount of its periphery to the side wall 21 of the cavity by a hinge element 16 (which may for example be composed of an elastomer).

The hinge element 16 enables the neck to be pivoted between its lowered position and a raised position in which it extends towards the outside of the planar part.

Figure 7:
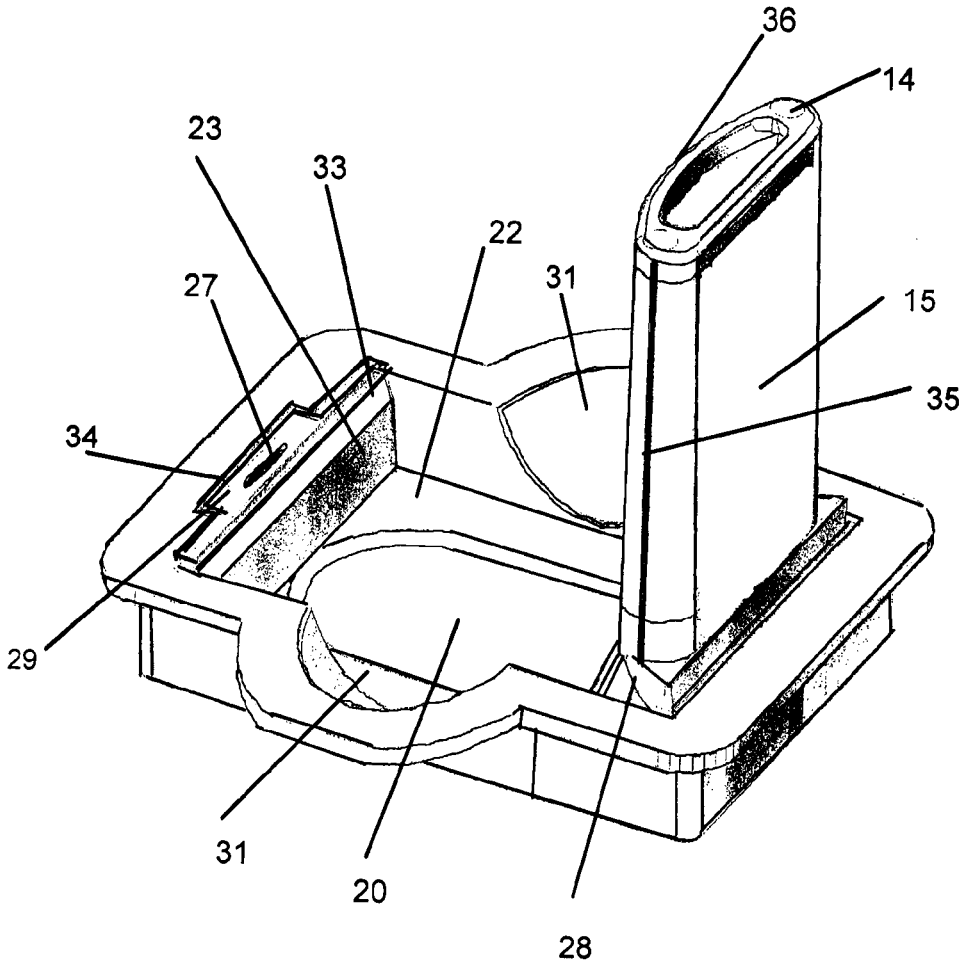
FIG. 7 shows an example of a beverage lid according to the invention, in a specific case in which the lid is not circular but can be fitted to a parallelepipedal or cylindrical receptacle.

In the embodiment shown by way of example in the drawings, the hinge element 16 is situated at the periphery of the cavity 20. It will be understood that, according to one embodiment, two lateral recesses 31 (FIG. 7) in the cavity 20 either side of the neck facilitate manual access thereto for bringing it into its raised position.

When it is in the lowered position, the lower end 15*b* of the neck 15 is against the side wall 21 of the cavity 20, a portion of wall which may be planar. The neck may be held in this position by a lug formed on this side wall 21 of the cavity so as to cooperate with the lower end of the neck. When the neck is in this lowered position, its internal channel is not in communication with the interior of the can to which the lid is fixed by means of an aluminum ring 12, 12A and the liquid contained in the can cannot enter the neck. Consequently the liquid cannot splash or overflow when the neck is brought into its raised position.

Figure 3:
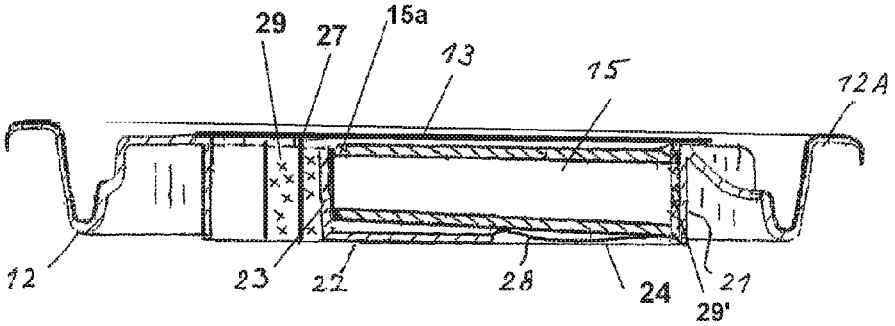
FIG. 3 is a schematic, sectional view of the lid with the neck lowered down.
Figure 4:
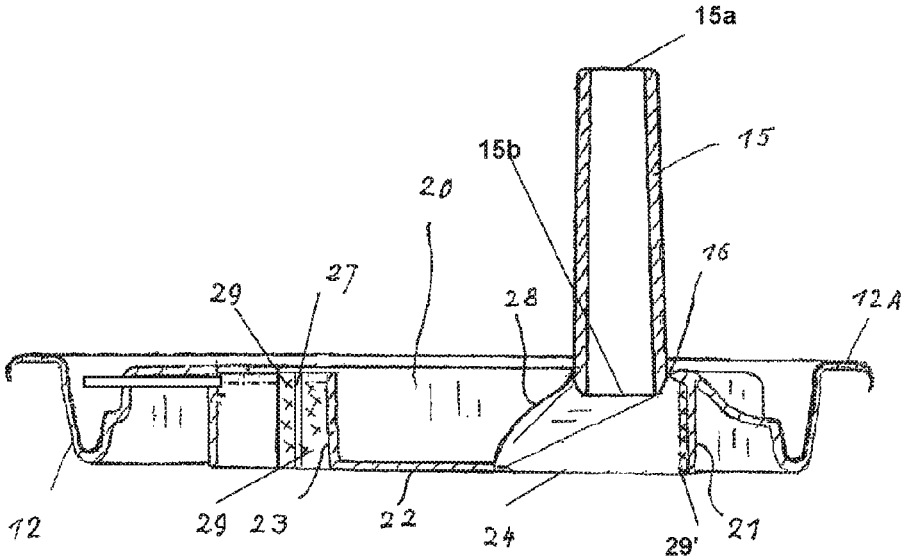
FIG. 4 is a sectional view of the lid with the neck in the raised position.

As also illustrated in FIGS. 3 and 4, when the neck 15 is in the lowered position, the free end 15*a* compresses the wall portion 23, preferably a planar portion, of the cavity 20.

This compression is transmitted to the slot 27, which remains closed (FIG. 3) and therefore leakproof, being provided in the elastomeric element 29.

A flexible leakproof membrane 28 connects the part of the periphery of the neck 15, which is not attached to the side wall of the cavity 20, to a part of the periphery of an opening 24 formed in the bottom 22 of the cavity. The flexible membrane 28 is folded over on itself when the neck is in the lowered position and prevents any escape of liquid along the neck 15. Another elastomeric element 29' may be provided at the side wall 21, ensuring the leakproofness of the base of the reclosed neck.

Hermetic closure of the can to which the lid is fixed is thus ensured.

On the other hand, when the neck is in the raised position, its lower end is released from the side wall 21 of the cavity and the flexible membrane or skirt 28 opens up the opening 24 in the bottom of the cavity 20, defining in leakproof manner, inside the cavity 20, a free passage between the interior of the can and the channel inside the neck 15. While the consumer is drinking the contents of the can by placing his or her lips over the free end of the neck and inclining the can, no liquid overflows onto the top of the lid. Furthermore, the cross-section of the free passage in the form of a funnel facilitates complete emptying of the can.

The neck 15 being raised, the pressure exerted by its free end 15*a* on the wall 23 is relieved and the longitudinal slot or recess 27 provided in the elastomeric element 29 may open (FIG. 4), so allowing ventilation of the can and formation of an air inlet.

It may be observed that the top of the lid according to the invention may be substantially flat when the neck is folded down.

This promotes lid stability in beverage can filling machines. Furthermore, the flat top of the lid means that the cans can still be stacked one on top of the other.

Given that it remains protected under a closure 13 until the latter is opened, the neck 15 is always of food quality and can therefore be put into the mouth without risk of contamination for the consumer. Furthermore, being of synthetic material, the closure does not cut and scratch a consumer's fingers.

Although made of a rigid or semi-rigid plastics material and an elastomeric element, the lid according to the invention is easy to manufacture by molding, optionally even by molding in one piece using methods known per se ("dual injection molding").

In general, the invention consequently relates to a lid incorporating a neck, which is capable of pivoting in known manner from a closed position to a raised position and has a free end which, in the reclosed position, compresses an elastomeric element, and a ventilation opening passing through said lid.

The invention relates more particularly to a lid of beverage can or container, substantially of non-elastomeric plastics material, e.g. of polypropylene, equipped with a rigid neck fixed so as to be able to pivot between a lowered position in which its internal channel is not in communication with the interior of the can and a raised position in which its internal channel is in communication with the interior of the can, comprising a planar part having a cavity generally oblong in shape, said cavity having a first side wall or side wall portion, a second side wall or side wall portion and a bottom which has an opening, said cavity accommodating the neck having a first free end and a second end attached to the side wall of the cavity by a hinge element so as to be able to pivot between a lowered position in which its second end is located against said side wall and the first end against said side wall opposite the wall of the cavity and a raised position towards the top of the planar part, a flexible leakproof membrane connecting a part of the periphery of said opening to the part of the periphery of the neck which is not attached to the side wall of the cavity, in which the wall of the cavity is capable of being compressed by said first end of the neck in the lowered position such that an opening or a slot provided across the neck in the lowered position and formed in an elastomeric material closes in leakproof manner under the action of said compression.

The wall or wall portion attached to the second end of the neck may also be composed of elastomeric material.

The wall 23 compressed by the free end of the neck may be of semi-rigid plastics material, and the elastomeric element 29 in which the slot 27 is located behind said wall. This wall 23 may take the form of a web of plastics material, for example polypropylene, for compressing the elastomeric element. The upper part of the web advantageously has a bevel 33 to facilitate engagement of the end of the neck on closing.

The elastomeric part of the lid may be designed in one piece and may partially extend over the inside of the periphery of the cavity and/or over the internal face of the lid.

The thickness of the wall which is or surrounds the elastomeric element 29 comprising the slot 27 may be increased by a plastics rib 34 to facilitate heat-sealing of a closure by coming into contact therewith and thereby ensuring double leakproof closing of the air inlet.

At its free end, the neck may comprise embossing 36, 14 intended to increase compression of the slot or of the opening in the lowered position. The neck may also be provided with lateral grooves 35 to facilitate gripping.

The invention also comprises a beverage container or can incorporating a lid as described above.

It goes without saying that the embodiment shown in the drawings and described above is merely an exemplary embodiment according to the invention and that the invention is in no way limited to this exemplary embodiment.

The invention claimed is:

1. A beverage can lid, substantially of non-elastomeric plastics material, comprising:

a rigid neck fixed to an exterior side of the lid so as to be able to pivot between a lowered position in which an internal channel of the neck is not in communication with an interior side of the lid opposite the exterior side, and a raised position in which the internal channel is in communication with the interior side of the lid, said lid being substantially flat and having a cavity in the one side that is generally oblong or circular in shape, said cavity having a first side wall portion, a second side wall portion, and a bottom which has an opening, said cavity accommodating the neck, the neck having a first free end and a second end attached to the second side wall portion of the cavity by a hinge element so as to be able to pivot between the lowered position in which the second end is located against said second side wall portion and the first free end is located against said first side wall portion of the cavity, and the raised position, a flexible leakproof membrane connecting a part of a periphery of said opening to a part of the second end of the neck which is not attached to the second side wall portion of the cavity, a slot at the first side wall portion in an elastomeric material, the slot communicating with the interior side of the lid when the neck is in the raised position and being oriented transverse to an axis of the interior channel of the neck when the neck is in the lowered position, the first side wall portion of the cavity being compressed by said first free end of the neck in the lowered position such that the slot closes in a leakproof manner under the action of said compression.

2. The lid according to claim 1, wherein the first side wall portion is composed of the elastomeric material.

3. The lid according to claim 1, wherein the first side wall portion is of semi-rigid plastics material and the elastomeric material is located behind said first side wall portion.

4. The lid according to claim 1, wherein the first side wall portion is composed of a web of plastics material for compressing the elastomeric material.

5. The lid according to claim 4, wherein an upper part of said web has a bevel to facilitate engagement of the first free end of the neck in the lowered position.

6. The lid according to claim 1, wherein the second side wall portion to which the neck is attached is also made of an elastomeric material and is arranged to ensure leakproofness with the second end of the neck when the neck is in the lowered position.

7. The lid according to claim 6, in which the elastomeric material of the second side wall portion is made of one part and extends partially under the interior side of the lid.

8. The lid according to claim 1, further comprising a rib of plastics that surrounds the elastomeric material comprising the slot so as to increase a thickness of the first side wall portion.

9. The lid according to claim 1, wherein the non-elastomeric plastics material of which the lid is substantially made is polypropylene.

10. The lid according to claim 1, wherein the elastomeric material is an elastomer sold under the trademark TREFSIN® or SANTOPRENE®.

11. The lid according to claim 1, wherein the neck is provided with lateral grooves to facilitate gripping.

12. The lid according to claim 1, wherein, at the first free end, the neck comprises embossing intended to increase compression of the slot in the lowered position.

13. The lid according to claim 1, wherein the lid is molded in one piece by a dual injection molding process.

14. A beverage can comprising:

a lid substantially of non-elastomeric plastics material and with a rigid neck fixed to said lid so as to be able to pivot between a lowered position in which an internal channel of the neck is not in communication with an interior of the can, and a raised position in which the internal channel is in communication with the interior of the can, the lid being substantially flat and having a cavity, said cavity having a side wall and a bottom which has an opening, the neck having a first free end and a second end attached to the side wall of the cavity by a hinge element so as to be able to pivot between the raised position and the lowered position, wherein in the lowered position the first free end of the neck is located and presses against a portion of the side wall made of, or integral with, an elastomeric material comprising a slot, or an elongate recess, passing through the lid, and perpendicular to an axis of the internal channel of the neck, the slot being adapted to close in a leakproof manner under lateral pressure exerted by said first free end of the neck in the lowered position, and wherein in the lowered position the second end of the neck is located and presses against a portion of said side wall opposite the cavity of elastomeric material, so also ensuring leakproofness.

15. The lid according to claim 1, further comprising a beverage can on which the lid is mounted.

* * * * *